United States Patent [19]

Odashima

[11] Patent Number: 4,648,462

[45] Date of Patent: Mar. 10, 1987

[54] AUTOMATIC FIRE EXTINGUISHER WITH INFRARED RAY RESPONSIVE TYPE FIRE DETECTOR

[75] Inventor: Takashi Odashima, Mitaka, Japan

[73] Assignee: Tekken Construction Co., Ltd., Tokyo, Japan

[21] Appl. No.: 817,091

[22] Filed: Jan. 8, 1986

[30] Foreign Application Priority Data

Apr. 23, 1985 [GB] United Kingdom ..... 8510357

[51] Int. Cl.[4] ..... A62C 37/02

[52] U.S. Cl. ..... 169/61; 250/339; 250/347

[58] Field of Search ..... 169/54, 56, 60, 61, 169/70; 250/338, 339, 342, 347, 349

[56] References Cited

U.S. PATENT DOCUMENTS 3,588,893 6/1971 McCloskey ..... 169/61

FOREIGN PATENT DOCUMENTS 55-33911 3/1980 Japan .

55-25862 9/1980 Japan .

56-28544 2/1981 Japan .

*Primary Examiner*—Andres Kashnikow

*Attorney, Agent, or Firm*—Leydig, Voit & Mayer

[57] ABSTRACT

An automatic fire extinguisher wherein a fire detector receives infrared rays from started fire flames in detecting area, as unified in the incident amount of the rays, at one of many light receiving elements which corresponds to the ray's incident angle into an assembly of infrared-ray passing filter and condenser lens, variations in detected output of the detector resulting from flaring of the fire flames are discriminated, the detected output higher than a predetermined level controllably drives an ejection nozzle to direct it towards the position of the flames and discharges a fire extinguishant out of the nozzle towards the flames, achieving thus a reliable detection of the fire irrespective of its distance from the detector as well as an effective extinguishment of only such started fire while preventing any erroneous operation due to other infrared ray sources.

11 Claims, 14 Drawing Figures

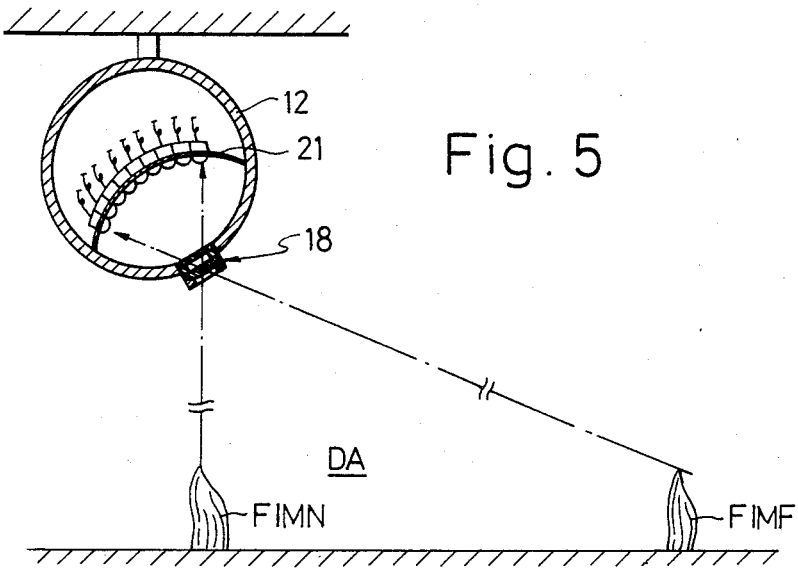
Fig. 5
Fig. 6A
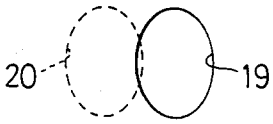
Fig. 6B
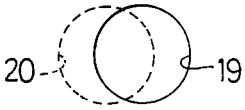
Fig. 6C
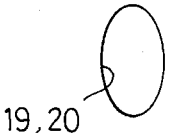
Fig. 9
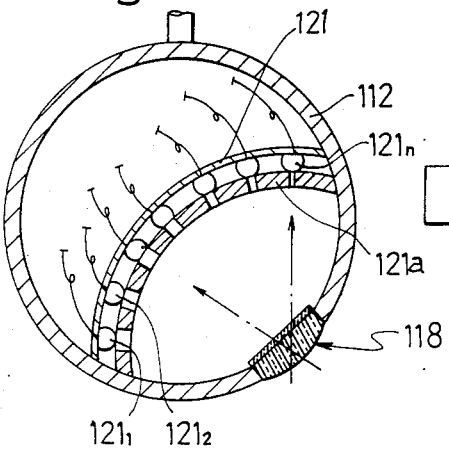
Fig. 10
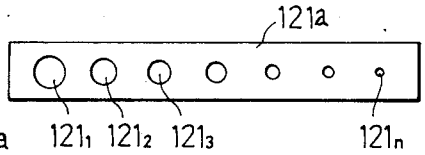

AUTOMATIC FIRE EXTINGUISHER WITH INFRARED RAY RESPONSIVE TYPE FIRE DETECTOR

TECHNICAL BACKGROUND OF THE INVENTION

This invention relates generally to automatic fire extinguishers and, more specifically, to an improved automatic fire extinguisher having means for receiving and detecting stationarily infrared rays emitted from a started fire irrespective of the distance of started fire position, and automatically directing a fire extinguishant ejecting nozzle towards the started fire position to extinguish it.

The automatic fire extinguishers of the type referred to include a fire detector and a fire extinguishant ejector mounted to a ceiling wall or the like of a room in a building so that, when the fire detector detects a fire started, a fire extinguishant tank is opened to disperse within the room a fire extinguishant out of a nozzle of the ejector to effectively extinguish the fire.

DISCLOSURE OF PRIOR ART

A typical example of conventional automatic fire extinguishers is so-called sprinkler system operatively associated with either or both of a smoke sensor and a heat sensor, in which a plurality of sprinklers are installed at many positions so that, as soon as the smoke or heat sensor generates a detection signal, the sprinklers will disperse a large amount of fire extinguishing liquid in all directions in the room to extinguish the fire. This system, however, has been defective in that, generally, an increased sensitivity of the sensor will result in an erroneous operation upon each detection of cigarrett smoke, raised room temperature due to heating and so on, so as to unnecessarily disperse the extinguishing liquid, whereas a sensitivity set to have the sensor actuated only upon a considerable amount of smoke will result in a considerable delay in the detection and extinguishing operation so as to prolong required time for the extinguishment, failing thus to perform expected function for early stage extinguishment. Yet, the system requires installations of many sprinklers, corresponding complicated mounting of extinguishant supply pipes and actuators, resulting in high installation costs and yet unfavourable appearance.

In order to remove the above defects, the present inventor has already proposed in Japanese Patent No. 1,035,605 an automatic fire extinguisher which comprises an infrared ray responsive type fire detector including a plurality of light receiving elements and an assembly of an infrared-ray-passing filter and condenser lens for receiving at one of the light receiving elements infrared rays from flames of a started fire depending on the position of fire started, means coupled to a fire extinguishant tank and movable along X and Y axes for directing an ejection nozzle towards the started fire position and ejecting fire extinguishant with the tank opened, and means responsive to an output of the fire detector for opening the tank.

Upon starting of fire, therefore, infrared rays passed through the filter will be incident on one of the light receiving elements through the condenser lens so that a signal indicative of the started fire position will be applied to the means for directing the ejection nozzle towards the started fire position and to the means for opening the tank, whereby the nozzle is controlled to be directed towards the fire position and the tank is opened to carry out an automatic fire extinguishing operation. The extinguisher of this Japanese Patent is advantageous in that the extinguishment can be realized with a prompt detection of the fire at an earlier stage of its start of less flaming, and with a single extinguishant ejecting device which thus simplifies the arrangement and remarkably reduces the installation cost, but is still defective in that the extinguisher unfavourably responds to infrared rays emitted from such other source than the started fire to be detected as, for example, sunlight, electric light, or various heat sources, so as to result in an erroneous extinguishing operation.

An attempt has been made to remove the defects of the foregoing automatic extinguisher, by means of a detection of variations in the intensity of the infrared rays caused by inherent flaring of the fire flames so as to discriminate the infrared rays of the fire started from those of any other infrared ray sources, and a substantially satisfactory result has been obtained by this attempt. In view of that the started fire flames gradually develop in the size, the attempt has also made it possible to discriminate the started fire flames from those of constant flames of a stove or the like. Variations in size of the fire flames take place, on the other hand, due to a difference in the distance of the fire from the detector, and resultant difference in the incident amount of infrared rays may be dealt with by varying discriminating level of the respective light receiving elements, but this measure may cause required circuit arrangement for processing output signals from the detector to become complicated to render manufacturing costs to be high.

TECHNICAL FIELD OF THE INVENTION

A primary object of the present invention is, therefore, to provide an automatic fire extinguisher capable of detecting the started fire at its early stage with a discrimination of the infrared rays of fire flames from those of other infrared ray sources than the fire flames in view of their inherent flaring to prevent any misoperation, and of unifying the incident amount of infrared rays at the light receiving elements in all events of fire starting at any position in the detection area of the extinguisher, with a simpler and inexpensive circuit arrangement.

According to the present invention, this object can be realized by providing an automatic fire extinguisher in which a fire detector is provided to receive infrared rays at one of a plurality of light receiving elements which corresponds to an incident angle of the rays into an assembly of an infrared-ray-passing filter and a condenser lens, an extinguishant ejecting nozzle means is controlled in the directivity by a signal processing means including means for discriminating intensity variations in detection output of the fire detector due to inherent flaring of fire flames started so as to be directed towards the started fire flames as rotated about vertical and horizontal axes of the nozzle means, an extinguishant tank communicating with the nozzle means is opened to discharge towards the flames the extinguishant from the tank in response to an output of the signal processing means, wherein a further means for substantially unifying the incident amount of the infrared rays at the respective light receiving elements in the fire detector is provided.

Other objects and advantages of the present invention shall become clear from the following description of the invention detailed with reference to a preferred embodiment illustrated in accompanying drawings.

BRIEF EXPLANATION OF THE DRAWINGS

FIG. 5 is an explanatory view for a state in which the fire detector of FIGS. 3A and 3B performs a fire detection;

FIGS. 6A 6B and 6C are explanatory views for the operation of the fire detector of FIGS. 3A and 3B;

FIG. 9 shows in a schematic section another embodiment of the fire detector in the extinguisher of the present invention; and FIG. 10 shows in a schematic plan view a light receiving array employed in the fire detector of FIG. 9.

Figure 1:
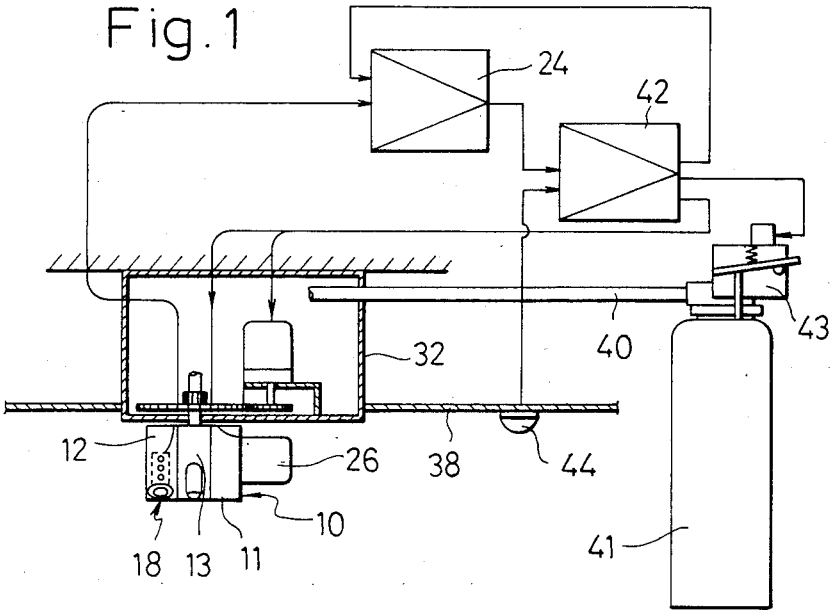
FIG. 1 is a schematic view showing an automatic fire extinguisher according to the present invention, which including an infrared ray responsive type fire detector.
Figure 2:
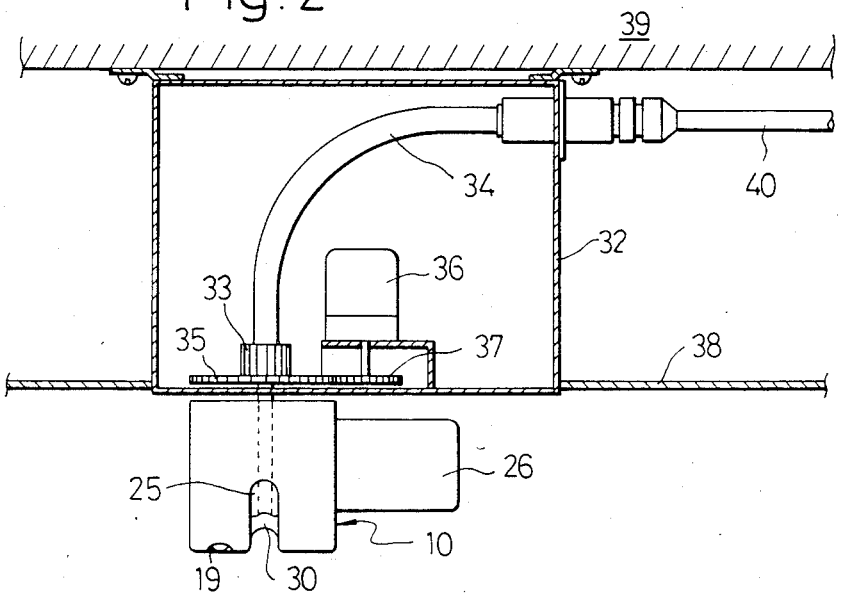
FIG. 2 is a side elevation as magnified at a part of the extinguisher of FIG. 1.
Figure 3A:
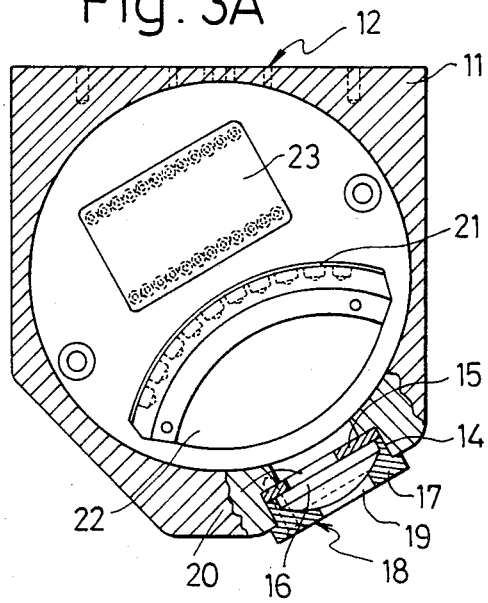
FIG. 3A shows in a section as magnified the fire detector in the extinguisher of FIG. 1.
Figure 3B:
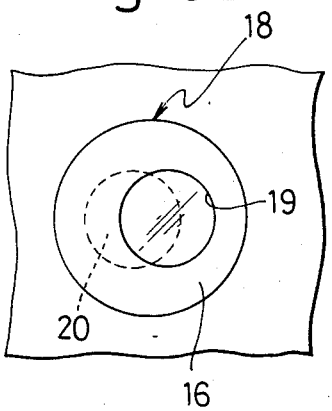
FIG. 3B shows in a plan view an assembly of infrared-ray-passing filter and condenser lens in the detector of FIG. 3A.
Figure 4:
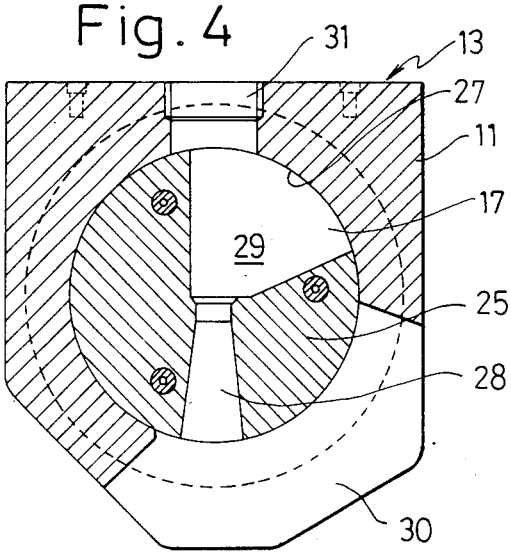
FIG. 4 shows in a section as magnified an extinguishant ejecting nozzle in the extinguisher of FIGS. 1 or 2.

While the present invention shall now be described with reference to the preferred embodiment shown in the drawings, it should be understood that the intention is not to limit the invention only to the particular embodiment shown but rather to cover all alterations, modifications and equivalent arrangements possible within the scope of appended claims.

DISCLOSURE OF PREFERRED EMBODIMENT

Referring to FIGS. 1 to 5, the automatic fire extinguisher according to the present invention includes a detection/ejection unit 10, a single housing 11 of which houses therein a fire detector 12 and a fire extinguishant ejecting nozzle 13 which are arranged horizontally side by side. The fire detector 12 is provided at its bottom with an opening 14 in which mounted is an assembly 18 of an infrared-ray-passing filter 15, a condenser lens 16 and a frame 17 circumferentially supporting the filter and lens. In the assembly 18, the frame 17 is formed to have a circular opening 19 and the filter 15 is to have a circular light passing region 20 of the same diameter as the opening 19, and these filter 15 and frame 17 are disposed to hold between them the condenser lens 16 with the region 20 and opening 19 mutually off-centred. Within the fire detector 12, a light receiving array 21 which comprises a plurality of light receiving elements arranged in a row is secured by means of a support frame 22, so that a detecting area DA is formed in a plane including the array and defining an angle somewhat smaller than 90 degrees with respect to the vertical line drawn from the centre of the lens 16, as shown in FIG. 5. The light receiving array 21 is provided to transmit detection signals of the light receiving elements through a terminal plate 23 to a signal adjusting circuit 24 which forms a part of signal processing means. In this case, infrared rays are to reach one of the light receiving elements of the array 21 through the condenser lens 16 and filter 15, which element is determined by the incident angle of the infrared rays. With the unit 10 installed to a proper position on a ceiling wall in a room as shown in FIG. 5, substantially the same amount of infrared rays is received at the respective light receiving elements, as will be described later, due to the off-centred disposition of the opening 19 of the support frame 17 and the light passing region 20 of the filter 15. In other words, the incident infrared ray amount reaching any one of the light receiving elements from any position in the detection area DA set according to the positional relationship between the condenser lens 16 and array 21 and to the detecting ability of the elements of the array 21 can be made always constant.

The fire extinguishant ejecting nozzle 13 in the unit 10 is provided with a rotatable columnar nozzle body 25 held rotatably within the housing 11, and the nozzle body 25 is axially coupled to an output shaft of a nozzle driving motor 26 fixed to one side of the housing 11 so as to be rotated in an angular range of at least 90 degrees and stopped at any desired position in this range. The nozzle body 25 is formed to have a nozzle hole 27 having an outlet 28 and an inlet 29, while the outlet 28 is slightly enlarged at the outer end and, as the nozzle body 25 is rotated by the motor 26, the outlet 28 is caused to shift its opening direction within a slot 30 made in the housing 11 from its bottom surface to a side surface over an angular range of more than 90 degrees as directed towards the detection area DA set by a positional relationship between the assembly 18 and the light receiving array 21. The inlet 29 is made in the body 25 in a sector shape in section so as to communicate with a fire extinguishant inlet 31 formed in the top of the housing 11, throughout the rotation of the nozzle body 25 over the substantially 90 degrees angular range. With this arrangement, the ejection nozzle 13 is made possible to discharge fire extinguishant in an angular range corresponding substantially to the detection area DA.

The detection/ejection unit 10, on the other hand, is mounted to the bottom surface of a body casing 32 of the automatic fire extinguisher through an axially rotatable joint 33 located within the casing 32 so that the unit 10 will be rotatable with the joint, while this joint 33 is coupled to a fire extinguishant supply duct 34 which is extended at its upper end outwardly from the casing 32 and coupled at the other lower end liquid tightly to an inlet port 31 made in the housing 11 of the unit 10 for supplying thereto the extinguishant. Inside the casing 32, a gear wheel 35 is axially secured to the lower end of the duct 34 through, if required, a proper reinforcing member, and the gear wheel 35 is meshed with a pinion 37 mounted on an output shaft of a unit driving motor 36 provided within the casing 32. With such arrangement, the rotation of the motor 36 will cause the unit 10 to be rotated 360 degrees through the pinion 37 and gear wheel 35 about an axis perpendicular to the rotary axis of the nozzle driving motor 26. The body casing 32 per se is embedded inside a ceiling liner 38 so as to expose the bottom surface of the casing 32 or only the lower end of the duct 34 projecting out of the joint 33 to be accessible from lower side of the ceiling liner, while the casing 32 is fixed at the top surface to an upper partition wall 39 of a building by means of bolts.

The supply duct 34 is coupled at the upper end extended out of the casing 32 to an end of an extinguishant supply pipe 40 which is coupled at the other end to an outlet of an extinguishant tank 41, while this tank 41 is provided to be opened by an actuator 43 actuated by output signals from the signal regulating circuit 24 and a controlling circuit 42. Upon opening of the tank 41 by the actuator 43, therefore, the fire extinguishant stored in the tank 41 under a proper pressure is urged to be sent to the nozzle body 25 through the supply pipe 40 and duct 34 to be ejected out of the opening 28 of the nozzle hole 27. The fire extinguishant contained in the tank 41 may be of either liquid or powdery type, or even a pressurized water. It is desirable in this embodiment to accommodate the tank 41 inside a partition wall of the room, with the supply pipe 40 extended from the tank through a side wall to the upper partition wall of the room and coupled to the duct 34.

In FIG. 1, the signal adjusting and controlling circuits 24 and 42 are shown to be outside the body casing 32, but they may be placed inside the casing 32, so as to receive a detection signal from the light receiving array 21 of the fire detector 12, as well as a detection output of a smoke or heat sensitive device 44 secured to the ceiling liner 38 at a proper position to be employed in conjunction with the fire detector 12, the latter output of the sensitive device 44 being provided prior to the former output of the detector 12. The signal processing means 24 provides outputs to the actuator 35, nozzle driving motor 21 and unit driving motor 28, so that the motors 26 and 36 will be energized to rotate the nozzle body 25 and detection/ejection unit 10 about their separate axes respectively for a desired rotary angle.

Figure 7:
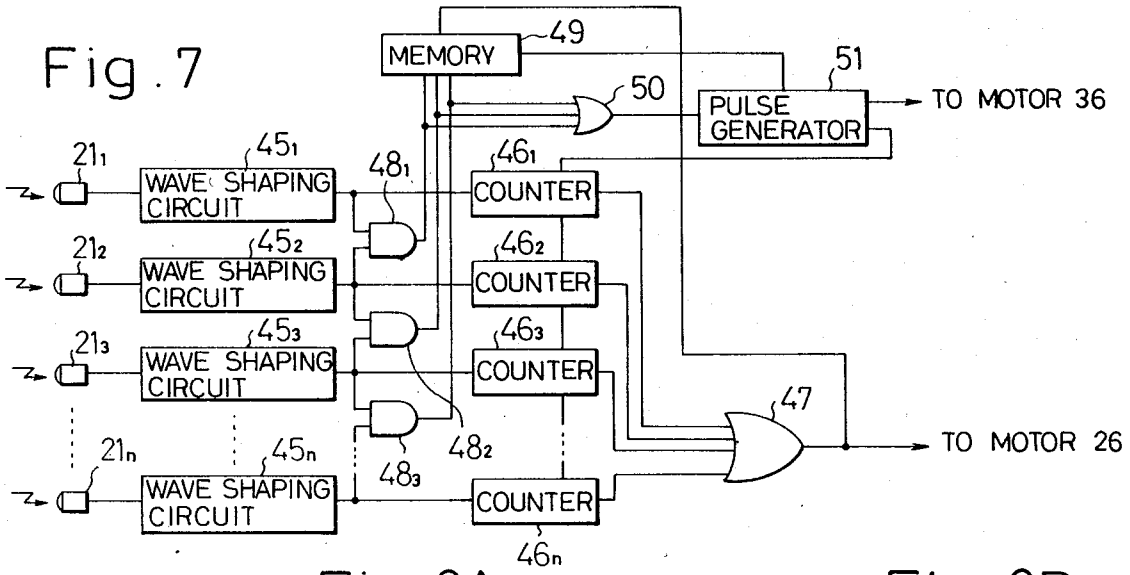
FIG. 7 is a block diagram in an embodiment of means for processing detected output signals of the fire detector in the extinguisher of FIGS. 1 or 2.
Figure 8A:
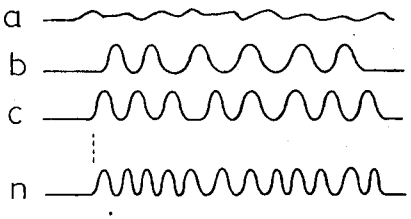
FIGS. 8A and 8B show waveforms of output signals appearing at a part of the signal processing means in FIG. 7.
Figure 8B:
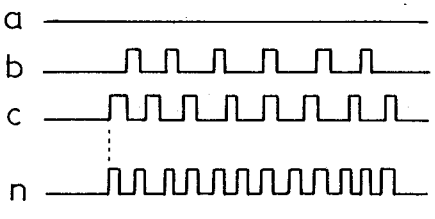

The arrangement in an embodiment of the signal regulating circuit 24 shall now be detailed with reference to FIGS. 7 and 8. The circuit 24 includes waveform shaping circuits $45_1$ to $45_n$ for shaping the detection output of the respective light receiving elements $21_1$ to $21_n$ which has such unevenness as shown by a waveform a in FIG. 8A due to inherent flare to the fire flames, into such rectangular pulse output b as in FIG. 8B.

The pulse output of the respective wave shaping circuits $45_1$ to $45_n$ are supplied to corresponding one of counters $46_1$ to $46_n$ and, when the pulse number of the output from any one of the wave shaping circuits has reached a set value, corresponding one of the counters $46_1$ to $46_n$ will send an output through an OR circuit 47 to the nozzle driving motor 26 to energize it. On the other hand, two outputs from adjacent two of the wave shaping circuits $45_1$ to $45_n$ are provided to each of AND circuits $48_1$ to $48_n$ so that, upon occurrence of such two outputs from the adjacent two wave shaping circuits, corresponding one of the AND circuits to the two wave shaping circuits provides the output to a memory 49 and another OR circuit 50. An output of this OR circuit 50 is provided to a pulse generator 51, which in turn provides to the counters $46_1$ to $46_n$ such an output that defines a set value of the respective counters and to the memory 46 a memory clearing output, and further the memory 49 provides an output signal which instructs a stopping position of the nozzle driving motor 26. From the pulse generator 51, further, an output for stopping the unit driving motor 36 being energized by an input from the smoke or heat sensitive device 44.

The operation of the automatic fire extinguisher according to the present invention shall be explained. If a fire starts in the detection area DA shown in FIG. 5, the fire is first sensed by the smoke or heat sensitive device 44, and a driving signal is given to the unit driving motor 36. When the detection/ejection unit 10 is thereby rotated to have the fire detector 12 directed towards the started fire position or, in other words, when the started fire flames are caught by the detection area DA of the light receiving array 21, the detection output of the light receiving element will be at such low level as shown by a in FIG. 8A and smaller than the set value of the wave shaping circuit, then the wave shaping circuit will produce no output as shown in FIG. 8B, whereas, when the detected output is at such high level as shown by b to n in FIG. 8A, the wave shaping circuit will produce such a rectangular pulse as shown by b to n in FIG. 8B. As a result, the fire extinguisher will not detect small flames of a stove or the like and, when the light receiving elements receive such infrared rays of high level involving no flaring or unevenness as those of the sunlight, the wave shaping circuit provides an output but no rectangular pulse is produced, whereby the counters are made disable and any infrared ray having no flaring is made not be detected. It will be readily appreciated from this that only the started fire flames are made to be the only object to be detected.

In the filter-condenser assembly 18, specifically, the opening 19 of the support frame 17 is not aligned with but offset from the light passing region 20 of the filter 15 in their centre so that, when the fire starts at the nearmost position FIMN with respect to the fire detector, the incident infrared ray amount at the light receiving element will be the minimum, whereas the fire started at the farmost position FIMF will render the incident infrared ray amount to be the maximum. That is, the centre of the opening 19 of the support frame 17 is positioned relatively to be forward with respect to the farmost position FIMF of the detection area DA, whereas the centre of the light passing region 20 of the filter 15 is positioned relatively to be backward. As a result, the infrared rays of the fire flames at the nearmost position FIMN will pass through the assembly 18 in such the minimum overlapping area between the opening 19 and the region 20 as shown in FIG. 6A. As the started fire position in the detection area DA becomes farther from the assembly 18, the overlapping area of the opening 19 and region 20 in the assembly 18 gradually increases as seen in FIG. 6B. The infrared rays from the fire flames at the farmost position FIMF in the area DA are caused to pass through the assembly 18 substantially in the fully overlapping area of the opening 19 and region 20 as shown in FIG. 6C. Accordingly, the fire started at any position in the detection area DA will result in a substantially constant incident amount of the infrared rays at the respective light receiving elements so that any possibility of erroneously determining relatively large fire flames occurring at the farmost position FIMF to be a small fire or relatively small flames at the nearmost position FIMN to be a large flame can be effectively prevented, and thereby an accurate fire detection can be realized.

The present invention may be modified in various ways. For example, in the assembly 18, the opening 19 of the frame 17 may not be offset from the light passing region 20 of the filter 15 but a received-light-amount control plate 121*a* having through holes of gradually decreased diameters and each opposing the respective light receiving elements is provided to cover the light receiving surface of an array 121 as shown in FIGS. 9 and 10, so that the incident infrared ray amount from the flames in the detection area DA at all the elements will be unified.

I claim:

1. An automatic fire extinguisher comprising a fire detector including a plurality of light receiving elements, an assembly of an infrared-ray-passing filter and a condenser for receiving infrared rays at one of said light receiving elements which corresponds to an incident angle of said infrared rays, and means for unifying received incident infrared ray amount from fire flames occurring at any position in a detection area of said detector to be substantially constant so long as the magnitude of said flames is the same; a fire extinguishant tank; an ejection nozzle communicating with said tank; means for processing a detection output signal of said fire detector; means responsive to an output of said signal processing means for directing said ejection nozzle towards a position of detected fire flames; and means responsive to an output of said signal processing means for opening said tank.

2. An extinguisher according to claim 1, wherein said unifying means comprises an opening provided in a support frame of said filter-condenser assembly and having the centre positioned forward with respect to the farmost position from said fire detector of said detection area and a light passing region provided in said infrared-ray-passing filter and having the centre positioned rearward with respect to said farmost position of the detection area.

3. An extinguisher according to claim 2, wherein said opening and region of said unifying means are disposed respectively to define a variable overlapping area which is minimum for said nearmost Position of said detection area and is maximum for said farmost position of the detection area.

4. An extinguisher according to claim 1, said unifying means includes an incident infrared-ray amount control plate covering a light receiving surface of said light receiving elements and having through holes the diameter of which are respectively gradually increased towards the element corresponding to said farmost position of said detection area.

5. An extinguisher according to claim 1, wherein said light receiving elements are arranged to form an array.

6. An extinguisher according to claim 2, said signal processing means includes means for discriminating variations in the intensity of said section output signal due to flaring of fire flames.

7. An automatic fire extinguisher comprising a fire detector including a plurality of light receiving elements arranged in an array, an assembly of an infrared-ray-passing filter and a condenser for causing received infrared rays to be incident at one of said light receiving elements, said light receiving array and assembly defining a detection area expanding angularly in a vertical plane passing through the array from a first position substantially right below to a second position away sidewards from said first position with respect to said fire detector, and means for unifying received incident amount of infrared rays from fire flames occurring at any point between said first and second positions of said detection area to be substantially constant when the magnitude of said flames is the same; a fire extinguishant tank; an ejection nozzle communicating with said tank for ejecting fire extinguishant towards said point of fire occurrence in the detection area; means for processing a detected output signal of said fire detector; means responsive to an output of said signal processing means for directing said ejection nozzle towards said point of fire occurrence; and means responsive to an output of said signal processing output for opening said tank.

8. An extinguisher according to claim 7, wherein said unifying means comprises an opening provided in a support frame of said assembly and having the centre positioned forward with respect to said second position of said detection area and an infrared-ray-passing region made in said filter and having the centre positioned rearward with respect to the second position.

9. An extinguisher according to claim 7, wherein said fire detector and ejection nozzle are provided in a common housing to form a detection/ejection unit.

10. An extinguisher according to claim 9, wherein said ejection nozzle comprises a nozzle body rotatably provided in said housing and having an opening for ejecting said fire extinguishant, said opening being provided shiftable in ejecting direction as disposed in a recess opened for an angular range from the bottom surface to a side surface of the housing.

11. An extinguisher according to claim 10, wherein said nozzle body is provided to be rotatable about a horizontal axis as driven by a first motor, and said detection/ejection unit is provided to be rotatable about a vertical axis as driven by a second motor, said first and second motors forming said means for directing said ejection nozzle.

* * * * *